United States Patent [19]

Schneider

[11] Patent Number: 4,603,632

[45] Date of Patent: Aug. 5, 1986

[54] INK RETURN SYSTEM FOR PRINTING MACHINES

[75] Inventor: Georg Schneider, Würzburg, Fed. Rep. of Germany

[73] Assignee: Koenig & Bauer Aktiengesellschaft, Fed. Rep. of Germany

[21] Appl. No.: 650,609

[22] Filed: Sep. 14, 1984

[30] Foreign Application Priority Data

Sep. 23, 1983 [DE] Fed. Rep. of Germany ..... 3334469

[51] Int. Cl.[4] ..... B41F 31/02

[52] U.S. Cl. ..... 101/364; 141/86; 141/99

[58] Field of Search ..... 101/350, 366, 364; 141/86, 98, 99, 263, 331, 333, 382; 37/61; 220/1 C, 1 V, DIG. 6; 406/167

[56] References Cited

U.S. PATENT DOCUMENTS

| | | | |
|---|---|---|---|
| 1,407,510 | 2/1922 | Bentham | 406/167 X |
| 2,965,140 | 12/1960 | Wonneberger | 141/333 X |
| 3,926,114 | 12/1975 | Matuschke | 101/366 X |
| 3,974,768 | 8/1976 | Grobman | 101/366 X |
| 4,121,222 | 10/1978 | Diebold et al. | 101/366 X |
| 4,181,076 | 1/1980 | Gattus | 101/366 X |
| 4,188,985 | 2/1980 | Osterman | 141/98 |
| 4,373,276 | 2/1983 | Schnell | 37/61 |

FOREIGN PATENT DOCUMENTS

| | | | |
|---|---|---|---|
| 1761439 | 3/1968 | Fed. Rep. of Germany . | |
| 2824335 | 6/1978 | Fed. Rep. of Germany . | |
| 3135711 | 6/1978 | Fed. Rep. of Germany . | |
| 110256 | 9/1925 | Switzerland | 141/331 |
| 300966 | 11/1954 | Switzerland . | |

*Primary Examiner*—Edgar S. Burr
*Assistant Examiner*—Moshe I. Cohen
*Attorney, Agent, or Firm*—Jones, Tullar & Cooper

[57] ABSTRACT

An ink return system for an inking fountain assembly in a rotary printing machine is disclosed. An ink return conduit assembly, which is comprised of inner and outer rigid telescoping ink return conduits, is supported by the inking unit. An inner end of one of the rigid conduits underlies an outlet port of an ink collecting trough and an outer end of the other of the conduits is placed above an ink receiving tank. Excess ink from the inking unit, which is collected in the ink collecting trough, flows through the ink return conduit to the receiving tank.

1 Claim, 3 Drawing Figures

INK RETURN SYSTEM FOR PRINTING MACHINES

FIELD OF THE INVENTION

The present invention is directed generally to an ink return system for a printing machine. More particularly, the present invention is directed to an ink return system for conducting surplus printing ink from an ink collecting trough to an ink vessel. Most specifically, the present invention is directed to an ink return system utilizing telescoping rigid ink return conduits. The telescoping ink return conduits are provided with an inlet opening which is placed beneath an outlet port of an ink collecting trough. Excess printing ink is collected in the trough and passes down through the outlet port and into the inlet opening of the ink collecting conduit. The ink flows down the rigid conduit to an outlet opening which is aligned with a filling funnel assembly of an ink tank. The collected ink can then be reused in the ink fountain of the rotary printing machine.

DESCRIPTION OF THE PRIOR ART

Printing ink for use in rotary printing machines is typically supplied to an ink fountain from which it is removed in a generally regulated manner by an ink fountain roller that rotates in the ink carried in the fountain. Ink adheres to the inking roller and is thus carried away from the fountain. Doctor blades or other similar metering means are often provided and are used to remove excess ink from the ink fountain roller.

A rinsing type ink fountain for a rotary printing machine may be seen, for example, in German published unexamined application No. 3135711. In ink fountains of this type, an inking bar with a doctor blade and a wiper assembly cooperate with a portion of the periphery of the ink fountain roller to form an ink reservoir that is connected by a hose connection to a suitable ink supply tank. Rinsing type ink fountains make it possible to use printing inks having low viscosity. However, with these low viscosity inks, there is apt to be leakage of the ink out of the reservoir and accordingly, various ink collecting means have been provided in the prior art. These collecting means typically use flexible hoses to feed the collected ink back to a tank in addition to supplying the ink to the ink reservoir. The use of such a large number of ink conducting hoses adversely effects the ease of servicing of the ink fountain. Further, since the ink return hoses must be connected directly to the ink collecting troughs, it is difficult to visually determine whether or not the ink collecting and return assemblies are operating properly.

SUMMARY OF THE INVENTION

It is an object of the present invention to provide an ink return system for a printing machine.

Another object of the present invention is to provide an ink return system for a rinsing type fountain.

A further object of the present invention is to provide an ink return system for a rotary printing machine which utilizes rigid ink return conduits.

Yet another object of the present invention is to provide an ink return system for a rotary printing machine in which the rigid ink return conduits are telescopingly adjustable.

Still a further object of the present invention is to provide an ink return system in which the ink return conduits afford visual access to the returning ink.

Still yet another object of the present invention is to provide an ink return system in which the rigid ink return conduits are easily adjusted and repositioned.

As will be discussed in greater detail in the description of the preferred embodiment as is set forth hereinafter, the ink return system in a printing machine in accordance with the present invention is comprised of rigid ink return conduits. Each conduit is preferably formed of telescopingly joined rigid rectangular conduit sections, with the inner section being positionable under an outlet port of an ink collecting trough and with the outer section having a drainage opening or discharge aperture positionable above a funnel shaped filling connecting piece which is attached to an ink receiving tank.

The rigid telescoping ink return conduit assembly is secured to the side frames of the press and has a low installation height which affords easy access to the inking unit itself. When it is necessary to change the position of the ink return conduit assembly, this is easily accomplished by quickly detaching the conduit from the side frames and shifting it. The ink return conduit assembly in accordance with the present invention is easily cleaned, since it is comprised of rigid, partially open conduit sections. When it is necessary to change ink colors, the rigid conduits used with a first color can be quickly removed and conduits used with the ink of the color being changed to can be quickly put in place without the use of any tools. Since the ink conducting conduits are partially open, and further since they do not directly contact the outlet ports of the ink collecting troughs, it is easy to visually ascertain that the ink return system is operating properly.

BRIEF DESCRIPTION OF THE DRAWINGS

While the novel features of the ink return system for rotary printing machines in accordance with the present invention are set forth with particularity in the appended claims, a full and complete understanding of the invention may be had by referring to the detailed description of the preferred embodiment, as set forth hereinafter and as may be seen in the accompanying drawings, in which:

DETAILED DESCRIPTION OF THE PREFERRED EMBODIMENT

Figure 1:
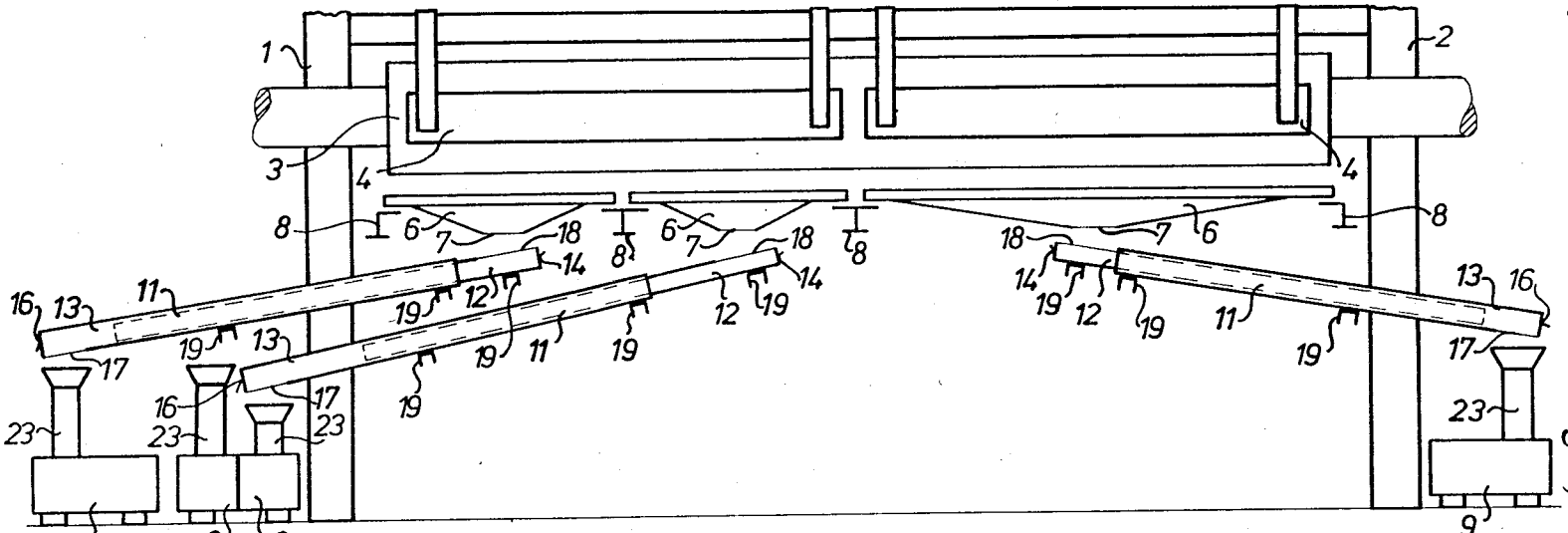
FIG. 1 is a schematic front elevation view of an inking unit using the ink return system in accordance with the present invention.

Referring initally to FIG. 1, there may be seen a driven screened ink fountain roller generally at 3. Ink roller 3 is supported in suitable bearing assemblies or the like in side frames 1 and 2 of an inking unit of the rinsing fountain type, as is generally shown in German application No. 3135711. As was discussed previously, an inking bar 4 together with a doctor blade and wiper (not shown) cooperate with a portion of the peripheral surface of the screened ink fountain roller 3 to form an ink reservoir which may be provided with a supply of low viscosity printing ink through a suitable hose connection or the like to an ink supply tank (not shown).

One or more ink collecting troughs 6 are placed beneath the screened ink fountain roller 3 and collect the low viscosity ink which escapes from the ink reservoirs. Since the ink fountain roller 3 may be used to simultaneously provide several different colors of ink, the ink reservoir may be divided into several different zones by suitable, generally conventional ink fountain dividing means. As the excess ink collected by the ink collecting troughs 6 will be reused, it is necessary to provide a separate ink collecting trough 6 for each separate color. As seen in FIG. 1, each ink collecting trough 6 may extend along a selected length of the ink fountain roller 3, such as along one fourth of the roller, as exemplified by the two troughs 6 at the left of FIG. 1, or over one half the length of roller 3, as seen at the right of FIG. 1.

Each of the ink collecting troughs 6 are generally funnel shaped and each terminates in a central, generally downwardly extending outlet port 7, formed at the lowest portion of each individual ink collecting trough 6. Ink collecting troughs 6 are suitably supported by appropriate support means, schematically shown at 8, with these support means 8 being secured to the side frames 1 and 2 of the printing unit in any acceptable manner.

Ink return assemblies, generally at 11, are disposed beneath the ink collecting troughs 6 and conduct the excess ink collected by the ink collecting troughs 6 back to ink tanks, generally at 9. Each of the ink return assemblies 11 is comprised of a generally rectangular, rigid inner conduit 12 and a similarly shaped, but slightly larger generally rectangular, rigid, outer conduit 13. Inner conduit 12 is telescopingly carried within its cooperating outer conduit 13 so that the length of each ink return conduit assembly 11 is adjustable, as seen in FIG. 1. The extended length of each assembly 11 will, of course, depend on the location of the ink collecting trough 6 with which the particular ink return conduit assembly 11 is being used.

Inner ink return conduit 12 has a closed inboard end wall 14, and outer ink return conduit 13 has a closed outboard end wall 16. The outboard end of the inner conduit 12 and the inboard end of the outer conduit 13 are left open to allow fluid to flow therebetween. A drainage opening 17 is provided at the outer end of the bottom side wall of outer rigid conduit 13 and an infeed or inlet opening 18 is provided on the upper surface of inner rigid conduit 12 at its inboard end, adjacent closed inboard end wall 14.

Figure 2:
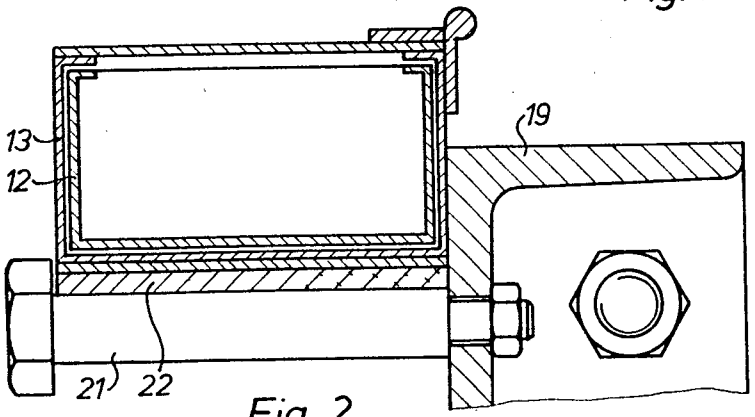
FIG. 2 is a cross-sectional elevational view through an ink return conduit assembly in accordance with the present invention and showing means for securing the ink return system to the printing machine.
Figure 3:
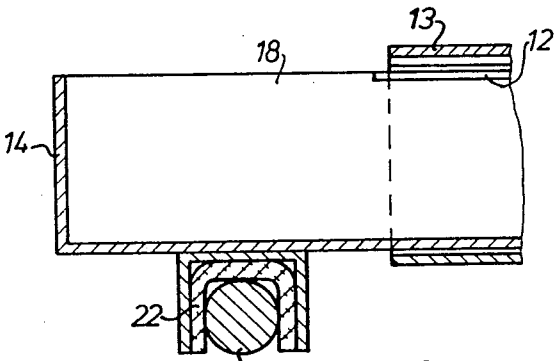
FIG. 3 is a longitudinal cross-sectional view of the ink return conduit assembly of FIG. 2.

A plurality of supports, generally at 19, are secured to the side frames of the inking unit, as may be seen in FIG. 1. Each of these supports has an outwardly extending screw 21 whose axis is generally perpendicular to the axis of rotation of the ink roller 3. As may be seen in FIGS. 2 and 3, a plurality of generally inverted U-shaped clamps 22 are welded or otherwise secured to the inner and outer rigid conduits 12 and 13, respectively. These clamps 22 are pressed over the shank portions of the screws 21 to support the ink return conduit assemblies 11 beneath the ink collecting troughs 6.

In use, the infeed opening 18 of the inner, rigid conduit 12 is positioned beneath the outlet port 7 of a selected one of the ink collecting troughs 6 and the drainage opening 17 of the outer, rigid conduit 13 is positioned above a filling connecting piece 23 which extends upwardly from one of the ink tanks 9. The support members 19 are attached to the side frames 1 and 2 as required to provide suitable support for the ink return conduit assembly 11. Excess ink collected in the ink collecting trough 6 can flow out through outlet port 7 into the inflow opening 18 of inner conduit 12 and through conduits 12 and 13 to the outflow opening 17 in conduit 13 and thence to the ink tank 9 where it is held for further use. Since the conduits 12 and 13 are telescopingly engageable, their lengths can be varied as desired, and further since they are rigid, they do not hinder access to the inking unit and do not get in the way. Additionally, since the inflow opening 18 is spaced from the outlet port 7 of the ink collecting trough 6, as is the outflow opening 17 spaced from the filling connecting piece 23 on ink tank 9, it is easy to visually check the flow of ink to make sure it is smooth and unobstructed.

While a preferred embodiment of an ink return system for a rotary printing machine has been fully and completely set forth hereinabove, it will be obvious to one of skill in the art that a number of changes in, for example, the materials used, the number of sections of conduit, the shapes of the inlet and outlet openings, the type of ink fountain, and the like could be made without departing from the true spirit and scope of the invention and that the invention is accordingly to be limited only by the following claims.

I claim:

1. An ink return system for returning surplus ink to an ink receiving tank of an inking unit in a rotary printing machine, said ink return system comprising:

at least a first, generally funnel shaped ink collecting trough underlying said inking unit and receiving said surplus ink from said inking unit, said ink collecting trough including a generally downwardly extending outlet port; and an adjustably positionable telescoping rigid ink return conduit assembly associated with said first ink collecting trough and having an inner rigid rectangular conduit and an outer rigid rectangular conduit, said inner and outer rigid rectangular conduits being telescopingly associated with each other, said inner and outer rigid rectangular conduits further including clamps for adjustable and removable attachment of said ink return system to side frames of said inking unit, a first end of said inner rigid rectangular conduit having a closed inboard end wall and an ink infeed opening provided in an upper surface of said first end of said inner rigid rectangular conduit, said ink infeed opening being positioned beneath, and being spaced from said outlet port of said ink collecting trough, a second end of said outer rigid rectrangular conduit having a closed outboard end wall and an ink drainage opening provided in a bottom surface of said second end of said outer rigid rectangular conduit, said ink drainage opening being positioned above, and being spaced from said ink receiving tank.

* * * * *